United States Patent [19]

Kawai et al.

[11] Patent Number: 4,558,298

[45] Date of Patent: Dec. 10, 1985

[54] ELEVATOR CALL ENTRY SYSTEM

[75] Inventors: Kiyoji Kawai, Gifu; Tadashi Omori, Nagoya, both of Japan

[73] Assignee: Mitsubishi Denki Kabushiki Kaisha, Tokyo, Japan

[21] Appl. No.: 473,358

[22] Filed: Mar. 8, 1983

[30] Foreign Application Priority Data

Mar. 24, 1982 [JP] Japan ..... 57-46551

[51] Int. Cl.[4] ..... B66B 13/00

[52] U.S. Cl. ..... 340/19 R; 187/29 R; 340/20

[58] Field of Search ..... 340/19 A, 19 R, 20; 187/29 R; 381/42; 364/513.5; 179/2 A

[56] References Cited

U.S. PATENT DOCUMENTS

| | | | |
|---|---|---|---|
| 3,909,533 | 9/1975 | Willimann | 364/513.5 |
| 4,403,114 | 9/1983 | Sakoe | 381/42 |
| 4,431,086 | 2/1984 | Moser et al. | 340/20 X |
| 4,460,066 | 7/1984 | Ohta | 340/19 R X |

OTHER PUBLICATIONS

"Voice Recognition" by Yasuhisa Niimi, Kyoritsu Publishing Co., Oct. 10, 1979, pp. 221–223, B. System for Collating Speaker Through Telephone, also pp. 53–57, 64–66, 212–215, and 234–235.

"Automatic Recognition of Speakers from Their Voices" by Bishnu S. Atal, *Proceedings of the IEEE*, vol. 64, No. 4, Apr. 1976, pp. 460–475.

"Digital Representations of Speech Signals" by Ronald Schafer et al., *Proceedings of the IEEE*, vol. 63, No. 4, Apr. 1975, pp. 662–677.

*Primary Examiner*—John W. Caldwell, Sr.
*Assistant Examiner*—Ellwood G. Harding
*Attorney, Agent, or Firm*—Leydig, Voit & Mayer

[57] ABSTRACT

An elevator call entry system comprises microphones mounted on the floors or in the car, oral message recognizing units producing an oral message signal indicative of a voice calling for a call entry with statement of the floor of destination, or of a voice calling for its cancellation, when said voices are supplied to said microphones, voiceprint recognizing units operable to recognize voiceprints of the voice supplied to said microphone and to produce an output signal when the voiceprint of the voice calling for a call entry is coincident with that of the voice calling for its cancellation, and call effecting units responsive to the output of the oral message recognizing units to issue a command to enter a call to the floor of destination and operable upon reception of an output signal from the voiceprint recognizing units to issue a command to cancel the call entry.

6 Claims, 8 Drawing Figures

ELEVATOR CALL ENTRY SYSTEM

BACKGROUND OF THE INVENTION

This invention relates to an improved call entry system for making elevator floor call and car call entries.

In an elevator system, a floor call is entered when a floor button provided on each floor is depressed, whereby an elevator car can be brought to the floor. On the other hand, a car call is entered when a destination button mounted in the car is depressed, whereby the car may be moved to the floor of destination.

With the recent progress in the art of voice recognition, it has been proposed to make these entries based on passengers' oral instruction or command. When a call command is uttered to a floor microphone by using one of a number of predetermined message formats, it is deciphered by a voice recognition unit, and a floor call is entered. Likewise, when a command stating the floor of destination is uttered to a car microphone, a car call is entered. If a wrong call entry has been made, a command for call cancellation is uttered with a predetermined message format or message type, whereby the wrong call entry is cancelled so that the unit is ready for entry of a correct call.

Assuming however that, with a call registered by a passenger, if another passenger utters a command to cancel the call intentionally or accidentally, the first call entry is cancelled, thus causing a turmoil. Moreover, since the call may be entered through oral instructions, as mentioned above, someone may enter useless calls through mischief. Should a number of these calls be entered haphazardly, the elevator car is stopped frequently to no purpose, so that the operating efficiency of the elevator is lowered considerably.

SUMMARY OF THE INVENTION

In view of the aforementioned inconvenience of the prior-art system, it is an object of the present invention to provide an elevator call entry system wherein the voiceprints of the voice command uttered by passengers are recognized, and a call to a floor is cancelled when the voiceprint of the voice command calling for a call entry to said floor is coincident with that of the voice command calling for its cancellation or when the voiceprint of the voice command calling for a call entry to a floor is coincident with that of the voice command calling for a call entry to another floor, thus providing for smooth call entry through voice recognition and preventing call occurrence from mischief.

According to the present invention, when a voice command calling for a call entry is supplied to a floor or car microphone, the call to the floor specified is entered. Simultaneously, the voiceprint of the voice command is recognized and, when the voiceprint of the voice command which has called for the call entry is coincident with that of the voice command calling for its cancellation, the call entry is cancelled. In this manner, there is no fear that the call entered by one pasenger is cancelled by another, and thus smooth call entry through oral commands may be assured.

In addition, when the voiceprint of a voice command calling for a call entry to a floor is coincident with that of a voice command calling for a call entry to some other floor, both call entries are cancelled, so that the occurrence of haphazard calls which lowered the operating efficiency of the system may be eliminated.

DESCRIPTION OF THE PREFERRED EMBODIMENTS

Reference is made to FIGS. 1 through 8 illustrating a preferred embodiment of the present invention when applied to a four-storied building.

Figure 1:
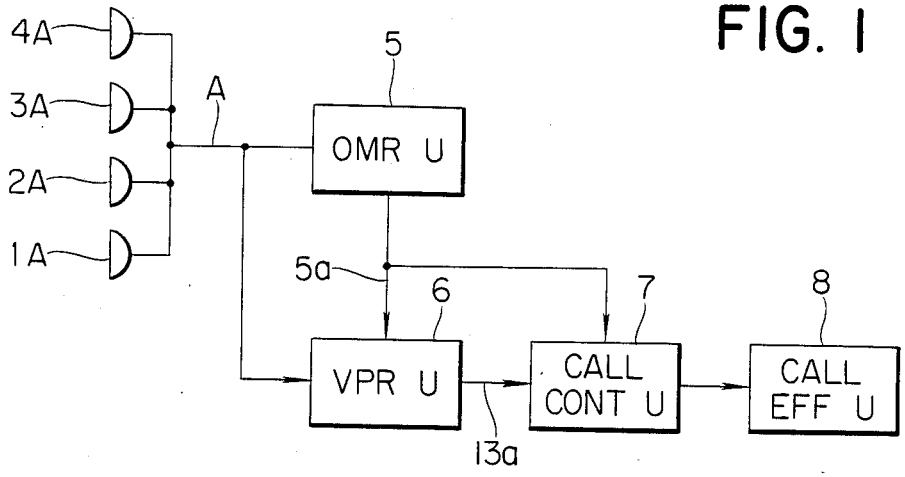
FIG. 1 is a block diagram showing a floor section of the elevator call entry device according to a preferred embodiment of the invention.

Referring to FIG. 1, the elevator stop on each floor has a set of microphones 1A through 4A adapted for receiving the voice uttered by passengers and for producing voice signals A. These signals A from the microphones are supplied to an oral message recognition unit (OMR U) 5 and a voiceprint recognition unit (VPR U) 6. The oral message recognition unit 5 is a device known per se and designed to produce an oral message signal **5*a* corresponding to the oral message entered into the microphones 1A through 4A as described below. The voiceprint recognition unit 6, details of which are described below, recognizes the voiceprint corresponding to the speaker of the oral message entered into the microphones 1A through 4A, and records the oral message signal 5*a* along with the corresponding voiceprint. A call control unit 7, details of which will be described below, is responsive to the oral mesage signal 5*a* and the output signal 13*a* from the voiceprint recognition unit 6 to produce signals to make the entry or cancel of various calls. A call effecting unit 8 operates to make the entry or cancel of the calls, in dependence upon the signals supplied from the call control unit 7**.

Figure 2:
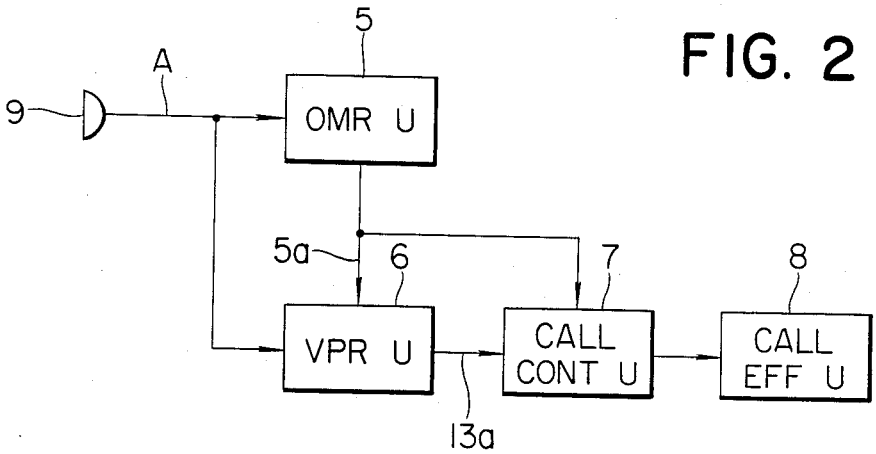
FIG. 2 is a block diagram showing a car section of the elevator call entry device shown in FIG. 1.

Referring to FIG. 2, a microphone 9 is mounted in an elevator car and designed to receive the voice call of the passenger in the car (car call) to produce a signal A. The remaining elements shown in FIG. 2 are equivalent to those shown in FIG. 1 and therefore the description therefor is omitted.

Figure 3:
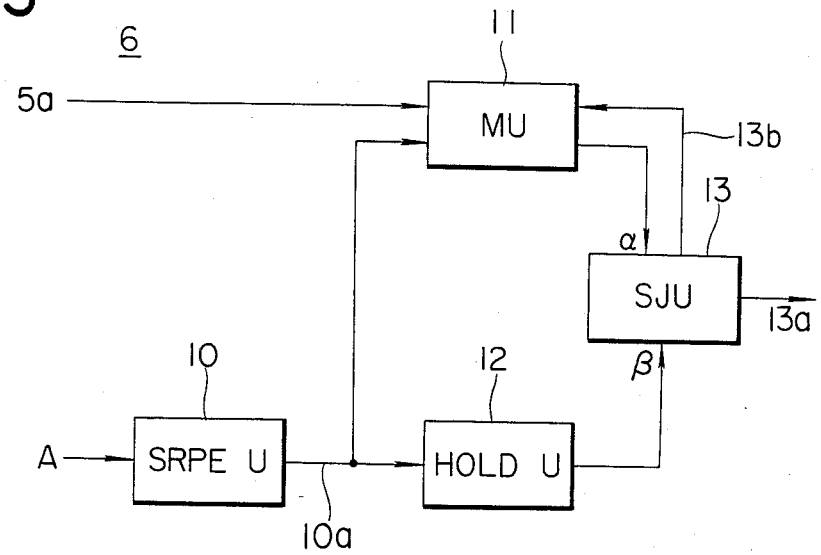
FIG. 3 is a block circuit diagram showing a voiceprint recognition unit shown in FIGS. 1 and 2.
Figure 7:
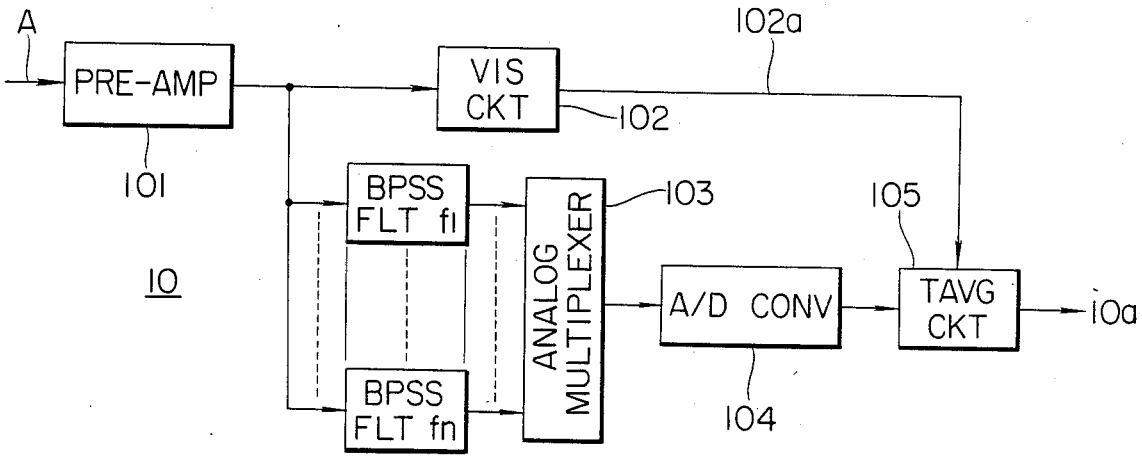
FIG. 7 is a block circuit diagram showing the structure of the speaker recognition parameter extracting unit shown in FIG. 3.

The inside structure of the voiceprint recognition unit 6 of FIGS. 1 and 2 is shown in FIG. 3. A speaker recognition parameter extracting unit (SPRE U) 10, details of which are shown in FIG. 7, extracts by a short-time spectrum parameters **10*a* proper to the speaker of the voice signal A. A memory unit (MU) 11 stores the oral message signals 5*a* and the corresponding speaker recognition parameters 10*a* as sets in an ordered sequence. A hold unit (HOLD U) 12 stores for a certain time the most recent one of the speaker recognition parameters 10*a* supplied thereto. A similarity judgment unit (SJ U) 13, details of which are described below, compares input signals $\alpha$ read out in ordered sequence from memory 11 to input signals $\beta$ supplied from the hold unit 12 to evaluate the similarity between these input signals on the basis of the Euclid distance and, should there be any similarity between the speaker recognition parameters of these input signals, emits a corresponding oral message signal as output 13***a*.

Figure 4:
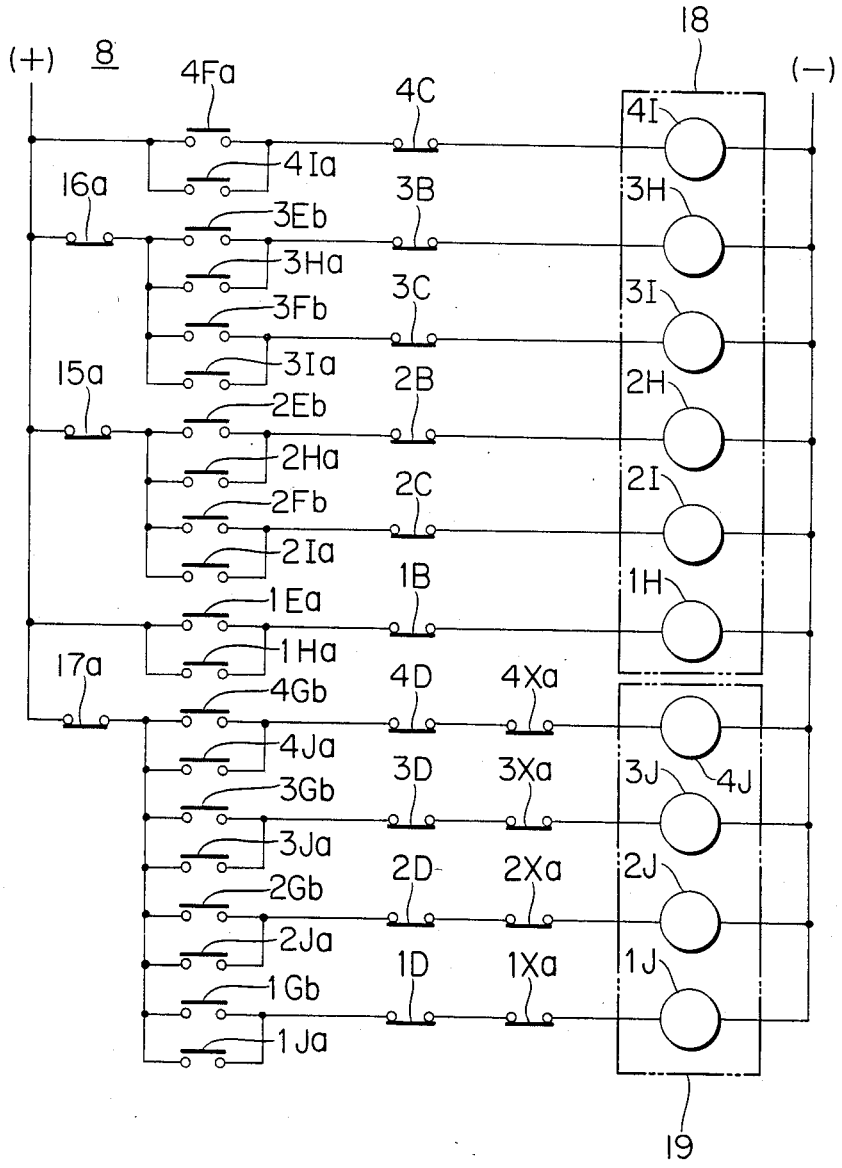
FIG. 4 is a circuit diagram of a call effecting circuit shown in FIGS. 1 and 2.

The detailed inside structure of the call effecting unit 8 of FIGS. 1 and 2 is shown in FIG. 4, wherein (+) and (−) designate a. d. c. voltage source. Normally closed contacts 1B through 3B of up call cancel relays of the first through third floor are opened when the car has arrived at the floor of origin of up call and is ready to respond to the up call. Normally closed contacts 2C through 4C of down call cancel relays of the second through fourth floor are opened when the car has arrived at the floor of origin of down call and is ready to respond to the down call. Normally closed contacts 1D through 4D of car call cancel relays of the first through fourth floors are opened when the car has arrived at a floor of destination of car call. A floor call entry circuit 18 adapted for entering calls made by passengers at the floors (floor call) has up call entry relays 1H through 3H that are activated responsive to up calls made at first through third floors to make an entry of the respective calls, and down call entry relays 2I through 4I designed to enter the down calls in the similar manner. A car call entry circuit 19 which makes the entry of car calls, i.e. calls made by passengers in the car, has car call entry relays 1J through 4J that are activated by car calls to the first through fourth floors so as to make an entry of the car calls. The relays 1H through 3H, 2I through 4I and 1J through 4J are provided with contacts 1H*a* through 3H*a*, 2I*a* through 4I*a* and 1J*a* through 4J*a*, respectively.

Figure 5A:
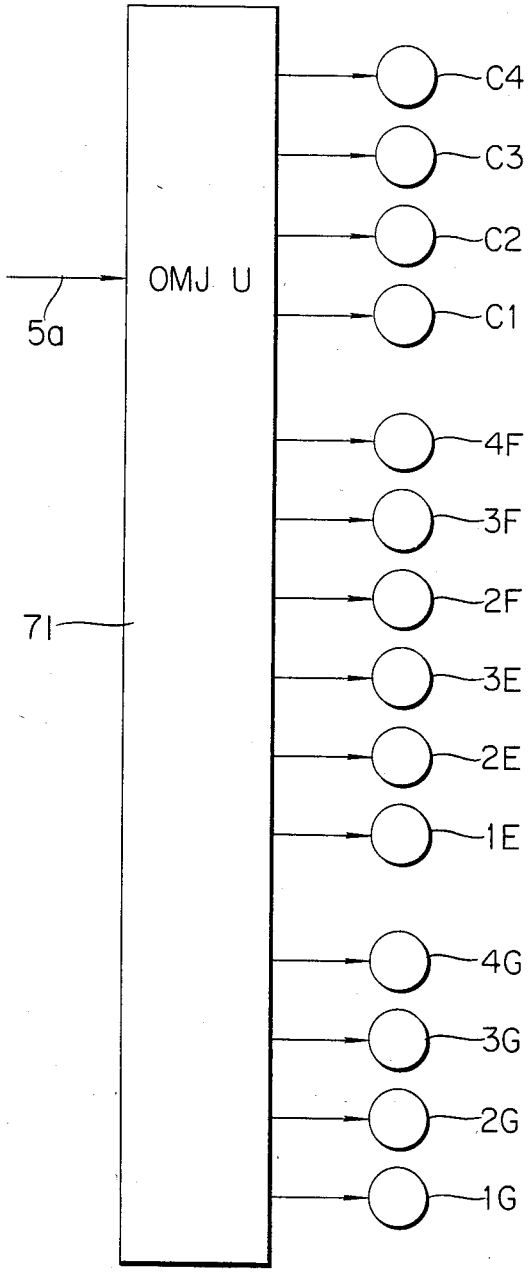
FIGS. 5A, 5B and 5C are detailed electrical connection diagrams showing the call control unit shown in FIGS. 1 and 2.
Figure 5B:
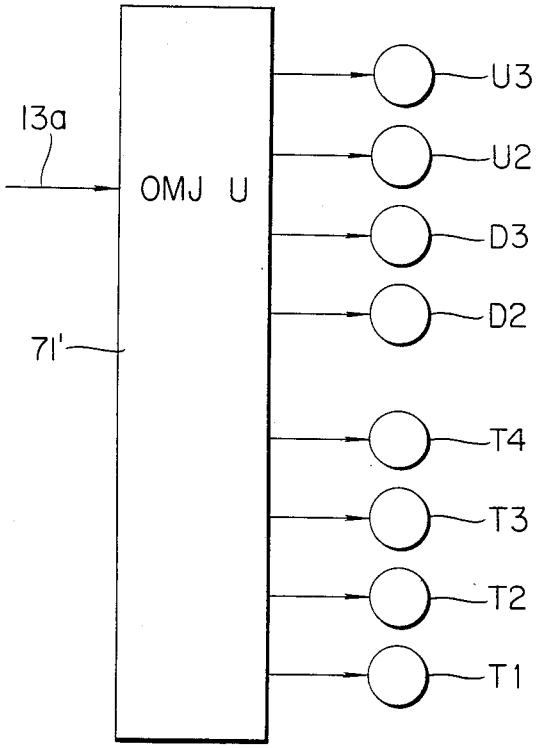
Figure 5C:
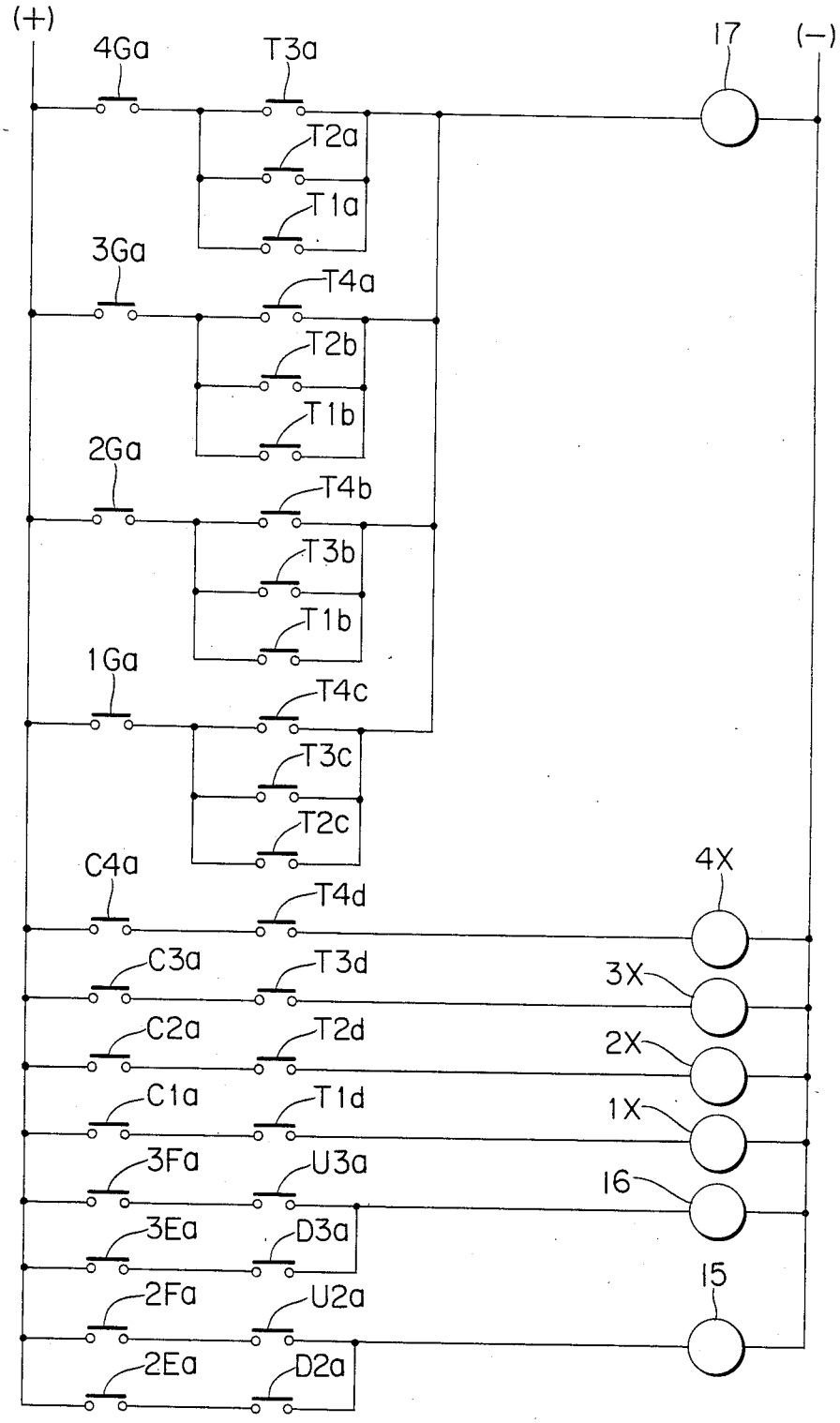

FIGS. 5A through 5C show the detailed structure of the call control unit 7 of FIGS. 1 and 2. Oral message signals 5*a* are supplied to an oral message judgment unit (OMJ ) 71 where the contents of the signals 5*a* are judged and output signals are issued for activating relays corresponding to the signal contents. Thus, when the passenger in the car has instructed to travel to one of the first to fourth floors, the corresponding one of the oral car call entry message relays 1G through 4G to the first through fourth floors are activated. When the up floor call or down floor call is made at one of the first to fourth floors, the corresponding ones of the oral up call entry message relays 1E through 3E at the first through third floors or the oral down call entry message relays 2F through 4F at the second through fourth floors are activated. Furthermore, when the passenger in the car intends to cancel the car call entry to the first through fourth floors, oral car call cancel message relays C1 through C4 through C4 to the first to fourth floors are activated.

Referring to FIG. 5B, the oral message signals 13*a* are supplied to an oral message judgement unit (OMJ U) 71' from which an output signal is issued for activating a relay corresponding to the message signal 13*a*. For instance, assuming that the oral car call entry message relay 4G to the fourth floor has been activated initially and the oral car call entry message relay to other floors or the car call cancel oral message relay C4 to the fourth floor are activated later by the same speaker who made the car call to the fourth floor initially, the judgment unit 13 issues an output signal 13*a* to activate a same speaker oral car call message relay T4 to the fourth floor, using the oral message judgment circuit 71'. Activating signals are issued to speaker oral car call message relays relays T3 through T1 in similar manner. When an oral up call entry message relay 3E at the third floor has been activated initially and the oral down call entry message relay 3F at the third floor is activated later by the same speaker who instructed the up call, an output signal is issued to activate a same speaker floor call oral message relay U3 for up call at the third floor. Output signals are issued in a similar manner by the oral message judgement unit 71' to a same speaker oral floor call message relay U2 for up call at the second floor, a same speaker oral floor call message relay D3 for down call at the third floor, and to a same speaker oral floor call message relay D2 for down call at the second floor.

The contacts of the respective relays shown in FIGS. 5A and 5B are shown in FIG. 5C, wherein the contacts are designated with suffixes "a" or "b" annexed to the reference numerals of the corresponding relays. A floor call cancel relay at the second floor 15 has its normally closed contact 15*a* within the call effecting unit 8 in FIG. 4. A floor call cancel relay at the third floor 16 has its normally closed contact 16*a* within the call effecting unit 8. A car call cancel relay 17 has its normally closed contact 17*a* similarly within the call effecting unit 8. Car call cancel relays to the first to fourth floors 1X through 4X are activated under correction commands made by the passengers and have contacts 1X*a* through 4X*a* within the circuit shown in FIG. 4.

It should be noted that the call control unit 7 and the call effecting unit 8 shown separately in FIGS. 1 and 2 are practically united into a single device controlling both the car call and the floor call as shown in FIGS. 4A and 5A through 5C.

It should be noted further that floor call cancel relays are provided to each of the first through fourth floors although only the relays for the second and third floors are shown. The relays provided to the first and fourth floors operate in the same manner as those for the second and third floors.

The device of the present embodiment operates as follows.

It is assumed that the car is at rest at the first floor, and that the passenger who has entered the car has instructed a car call entry by uttering a predetermined oral message, such as "second floor enter", to the microphone 9. The microphone then issues a voice signal A corresponding to the message. The recognition unit 5 recognizes this signal and issues an oral mesage signal 5*a*. A car call relay to the second floor 2G is activated to close its contact 2G*b* so that a car call entry circuit 19 is activated through a closed circuit (+) - 17*a* - 2G*b* - 2D - 2X*a* - 2J - (−) to make the entry of car call to the second floor. Thus a contact 2J*a* of the car call entry relay 2J is closed for self holding.

At the same time, the voiceprint recognition unit 6 stores the voiceprint of and the floor stated by the passenger calling for car call entry to the second floor.

The art of voiceprint recognition, shown by way of an example in "Voice Recognition" written by Yasuhisa Niimi, Chapter 6 "Speaker Recognition", Kyoritsu Publishing Co. Ltd., Oct. 10, 1979, 1st edition, will be described below by referring to FIG. 3.

A speaker recognition parameter extracting unit 10 extracts speaker recognition parameters from voice signal A, while the hold unit 12 stores the most recent speaker recognition parameter transiently. At the same time, a memory 11 stores the oral message signals 5*a* and the extracted speaker recognition parameters in an ordered sequence. The similarity judgement unit 13 compares the most recent speaker recognition parameter and the previously stored parameters and searches for those parameters originating from the same speaker. When any previously stored parameter and the most recent speaker recognition parameter are found out to be originating from the same speaker, the oral message signals 5*a* relating to these two parameters are contrasted to each other to grasp the situation and oral message signals 13*a* are outputted for activating relevant one of the relays shown in FIG. 5B.

It should be noted that, when the car is driven in accordance with car calls, the voiceprint recognition unit 6 is activated for a certain time period after the car door has been opened in response to the car call, and deactivated after a certain time period to reset the speaker recognition. Alternatively, the unit 6 may be deactivated after a certain time period since the car has left the floor. When the car is driven in accordance with floor calls, the unit 6 is activated as long as the car door is closed, and deactivated upon opening of the car door in response to the floor call to reset the speaker recognition.

When the passenger has announced a predetermined message such as "second floor correct" in order to correct his previous entry of car call to the second floor, second-floor oral car call cancel message relay C2 is activated by the message judgment circuit 71 and its contact C2*a* is closed. At the same time, the speaker's voice signal is supplied to the voiceprint recognition unit 6 to detect the voiceprint and make a check as to whether it is similar to the previously stored voiceprints. If the result of this check is affirmative, an oral message signal 13*a* is outputted through a message judgment circuit 13' which then operates to activate a second-floor same speaker car call message relay T2. In this manner, contact T2*d* is closed for completing a circuit (+) - C2*a* - T2*d* - 2X - (−). Thus a relay 2X is activated and its contact 2X*a* opened so that the car call entry relay 2J is deactivated and the car call to the second floor is cancelled. When the speaker has uttered a message "third floor enter", the car call relay 3G for the third floor is activated as mentioned hereinabove so that its contact 3G*b* is closed and the car call to the third floor is entered. Supposing that another passenger has announced "second floor correct" at this time, no message signal 13*a* is issued from the similarity judgment unit 13 of the voiceprint recognition unit 6. Therefore, the second-floor car call cancel relay 2X is not activated so that the car call to the second floor is not cancelled.

The car call to the second floor is not cancelled when the passenger who has called for a car call to the second floor has uttered "third floor correct". Likewise, the previously entered car call to the second floor is not cancelled when the passenger who has entered the car call to the second floor has again announced "second floor enter".

Turning now to floor calls, when a speaker has announced "second floor up enter", a contact 2E*b* of a second floor up call relay 2E is closed to activate an up call entry relay 2H so that the up call at the second floor is entered. When the same speaker has announced "second floor up correct", the second-floor up call cancel relay D2 is activated to close its contact D2*a* so that the cancel relay 15 is activated to close its contact 15*a* to cancel the up call at the second floor. The up call is not cancelled even when another passenger has announced "second floor up correct", in the same manner as mentioned hereinabove.

When a passenger at a third floor has announced "third floor up enter" and then "third floor down enter", the corresponding voice signals are recognized by the message recognition unit 5 so that third-floor oral message up and down call relays 3E and 3F are activated to close their contacts 3E*b* and 3F*b*. Thus the entry relays 3H, 3I are activated and the up and down calls at the third floor are entered. However, the voiceprint recognition unit 6 adjudges these messages to have been announced by the same speaker and issues a call entry cancel signal, whereby the third floor call cancel relay 16 is activated and its contact 16*a* opened. In this manner, both the up and down calls at the third floor are cancelled. It is the same with the down call. Actuation by the same passenger of the up and down floor buttons may not be identified easily in the conventional service, but it is now possible with the present embodiment.

It is the same with car calls. Any entry of plural car calls by the same passenger is cancelled.

The oral message recognition unit 5 and the voiceprint recognition unit 6, especially the speaker recognition parameter extracting circuit 10 and the similarity judgment unit 13, are described below in more detail.

Figure 6:
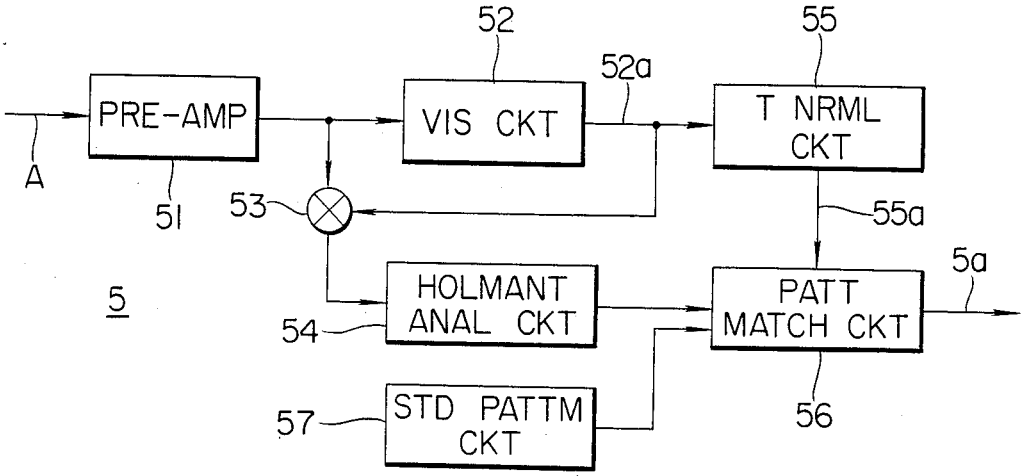
FIG. 6 is a detailed electrical connection diagram showing the oral message recognition unit shown in FIGS. 1 and 2.

In the oral message recognition unit 5, as shown in FIG. 6, voice signals A supplied thereto are amplified to a suitable level at a preamplifier 51 and then supplied to a voice interval sensor circuit (VIS CKT) 52. In the circuit 52, the beginning and the end of the oral message are sensed, based on the input signal level, and a gating signal 52*a* is issued therefrom depending on the duration of oral message input. The output of the preamplifier 51 is also supplied through a gate 53 to a Holmant analysis circuit (HOLMANT ANAL CKT) 54 depending on the duration of oral message input. The circuit 54 outputs a Holmant pattern indicative of the phonemic characteristics of the oral message. The gating signal 52*a* is also supplied to a time normalizing circuit (TNRML CKT) 55 which then issues a signal 55*a* to a pattern matching circuit (PATT MATCH CKT) 56 instructing the circuit 56 to make corrections as to the time axis in order to correct for discrepancies between the output pattern and standard pattern caused by fluctuations in the announcing time intervals. In the pattern matching circuit 56, the Holmant pattern is contrasted to the standard pattern stored in a standard pattern memory (STD PATT M CKT) 57. This contrasting operation is carried out based on the corrected time axis as mentioned above and an oral message signal 5*a* having a uniform or coincident pattern is supplied from the circuit 56.

This output signal is supplied to the call control unit 7. In the oral message judgment circuit 71 of the call control unit 7, it is judged which of the oral message signals 5*a* has been supplied thereto and the relay corresponding to the oral message signal supplied from the unit 5 is activated. In the above example, the second floor car call entry relay 2G is activated.

In the voiceprint recognition unit 6, the voice signal A from microphone 9 is supplied to the speaker recognition parameter extracting circuit 10. Referring to FIG. 7, the voice signal A is amplified to a suitable level in a preamplifier 101 (FIG. 7) and then supplied to a voice interval sensor circuit (VIS CKT) 102 where the beginning and the end of the oral message are sensed based on the input signal level and a gating signal 102*a* is issued pending duration of voice signal inputting. The amplified voice signal is also supplied to bandpass filters (BPSS FLT) fl through fn whereby frequency components corresponding to the respective filters are extracted. These component signals thus extracted are sequentially selected by an analog multiplexer 103 and converted into digital values by an A/D converter 104. The digitized component signals are averaged by a time averaging circuit (TAVG CKT) 105 for the respective frequencies and during the time the gate signal 102*a* remains activated, and a speaker recognition parameter signal 10*a* is issued from the extracting circuit 10 as output signal. This parameter signal 10*a* represents in which rate each of the frequency component is included in the voice signal during the time the voice signal is issued. Each said signal 10*a* is stored transiently in the hold unit 12. Simultaneously therewith, the signal 10*a* is stored as it is produced in the memory 11 along with the oral message signal 5*a*.

Figure 8:
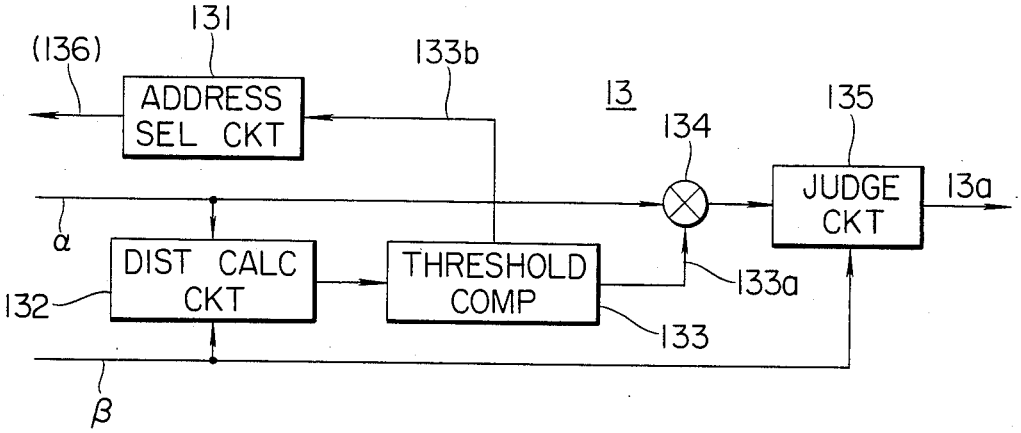
FIG. 8 is a block diagram showing the structure of the similarity judgment unit shown in FIG. 3.

As shown in FIG. 8, a speaker recognition parameter $\beta$ stored in the hold unit 12 and a speaker recognition parameter $\alpha$ stored in the memory 11 and selected by an address signal 13*b* issued by an address selecting circuit 131, are supplied into a distance computing circuit 132 where Euclid distances of the two parameters $\alpha$, $\beta$ are computed. The result is supplied to a threshold comparator 133 where it is judged whether the result is within a predetermined range. If the result is within the range, that is, if the two parameters are similar to each other, a gating signal 133*a* is issued for opening a gate 134 so that the oral message signal stored with the selected speaker recognition parameter is transmitted through the gate. If the above result is outside the predetermined range, an update signal 133*b* is supplied to the select circuit 131 which then selects the next speaker recognition parameter stored in the memory 11. The aforementioned procedure is repeated until speaker coincidence is reached, that is, until the distance is within the predetermined magnitude range.

The previously stored oral message signal $\alpha$ suppied through gate 134 and the most recent oral message signal $\beta$, both originating from the same speaker, are supplied to judgement circuit (JUDGE CKT) 135 where it is judged which of the aforementioned relays T1 through T4, U2, U3, D2 and D3 should be activated, and a corresponding output signal 13*a* is issued. For example, when the third-floor oral up call entry message relay 3E is activated initially and the third-floor oral down call entry message relay 3F is activated later on by the same speaker, an output signal 13*a* is issued for activating third-floor same speaker oral up floor call message relay U3. When the same thing has happened on the other floors or in the other travelling direction, an oral message signal is issued for activating a relevant one of the relaYS U2, D2 and D3. As another example, when the fourth-floor car call entry message relay 4G is activated initially, and an oral car call message relay to any other floor or a car call cancel relay to fourth floor is activated later on by the same speaker, an output signal 13*a* for activating the fourth-floor same speaker oral car call message relay T4 is issued. When the same thing has happened with car calls to other floors, a signal 13*a* is issued for activating a relevant one of the oral message relays T3 through T1.

The most recent oral message signal 5*a* supplied from the oral message recognition unit 5 is suppied to oral message judgment unit 71 which then activates one of the oral message relays corresponding to the oral message. The oral message signal 13*a* supplied from the similarity judgement unit 13 is introduced into the oral message judgement unit 71' which then activates one of the same speaker oral message relays corresponding to the oral message.

Thus, when the same speaker intends to make entry of different car calls, as when he has initially entered a car call to third floor and tried to enter a car call to first floor, both the entry oral message relay 1G and the same speaker car call oral message relay T3 are activated so that car call cancel relay 17 of the circuit of FIG. 5C is activated so that its contact 17*a* is opened to deactivate the entry relay 3J and cancel the entry.

When the same speaker has intended to enter up and down floor calls at the same floor, as when a passenger on the second floor has entered an up call and tried to enter a down call, both the up and down call entry oral message relays 2E and 2F as well as the same speaker floor call oral message relay U2 are activated simultaneously so that the floor call cancel relay 15 of the FIG. 5C circuit is activated. Thus the contact 15*a* (FIG. 4) is opened to deactivate entries relays 2H and 2I to cancel the entry.

Furthermore, when the same speaker has entered a car call and tried to cancel the call at a later time, as when he has entered a car call to first floor and intends to cancel the call, both the same speaker oral car call message relay T1 and the car call cancel oral message relay C1 are activated. Thus the contact 1X*a* (FIG. 4) is opened to deactivate the entries relay 1J to cancel the entry.

What is claimed is:

1. An elevator call entry device in which a cell is entered by the voice uttered by a passenger, said device comprising voice receiving means provided on the floor or in an elevator car and operable to receive the voices uttered by the passenger and to produce a signal corresponding thereto;

oral message recognizing means responsive to signals from said voice receiving means to extract therefrom signals indicative of a voice demanding a call entry and stating the floor of destination or a voice demanding cancellation of a call entry, and to produce oral message signals indicative of the contents of the extracted signals;

voiceprint recognition means operable to recognize and sequentially store voiceprints of the voice signals received from said voice receiving means and to supply an output signal when the previously stored voiceprint of the voice demanding a call entry is coincident with the voiceprint of a voice demanding subsequent cancellation of the call entry;

call control means responsive to said oral message signal to supply a command to enter the demanded call in accordance with said oral message signal, said call control means being connected to said voiceprint recognizing means and operable to supply a command to cancel the call entry upon reception of said output signal from said voiceprint recognizing means; and call effecting means responsive to an entry command and an entry cancellation command issued by said call control means to effect call entry and call entry cancellation.

2. The call entry device as claimed in claim 1 wherein said voiceprint recognizing means is connected to said voice receiving means and said oral message recognizing means for receiving signals from these means, and comprises; speaker recognition parameter extracting means for receiving said voice signals and extracting parameters indicative of the voiceprint from the voice signals; memory means connected to said extracting means to receive said parameters and said oral message signals and to store them sequentially as sets; hold means connected to said extracting means to store temporarily the speaker recognition parameter of the voice of the most recent oral message; and similarity judgment means connected to said hold means and said memory means for adjudging whether the speaker recognition parameter is the same as that stored in said memory means of the voice calling for an entry cancellation and to issue an output signal to cancel an entry when there exists such recognition parameter.

3. The call entry device as claimed in claim 1 wherein said voiceprint recognizing means is operable to issue an output signal to cancel a previously demanded call entry when a new call entry different from said previously demanded call entry has been demanded with a voice same as the voice of the previously made call entry.

4. The call entry device a claimed in claim 3 wherein said new call entry is a call entry demand to a floor different from the floor of a previously made call entry.

5. The call entry device as claimed in claim 3 wherein said new call entry is a call entry demand for a direction opposite to that of a previously made call entry.

6. An elevator call entry device in which a call is entered by a voice uttered by a passenger, said device comprising first and second voice receiving means provided on each floor and in an elevator car respectively and operable to receive voices uttered by passengers and to produce output signals corresponding thereto;

first and second oral message recognizing means associated with said first and second voice receiving means respectively, and operable to receive signals from said first and second voice receiving means to extract therefrom signals indicative of a voice demanding a call entry and stating the floor of destination or a voice demanding cancellation of a call entry, and to produce oral message signals indicative of the contents of the extracted signals;

first and second voiceprint recognizing means associated with said first and second voice receiving means and operable to recognize and sequentially store voiceprint of the voice signals received from said voice receiving means and to produce an output signal when the previously stored voiceprint of the voice demanding a call entry is coincident with the voiceprint of a voice demanding subsequent cancellation of the entry;

call control means responsive to said oral message signals from said first and second oral message recognizing means to supply a command to enter the demanded call in accordance with said oral message signal, said call control means being connected to said first and second voiceprint recognizing means to supply a command to cancel an call entry upon reception of said output signals from said first or second voiceprint recognizing means; and call effecting means responsive to an entry command and an entry cancellation command issued by said call control means to effectuate call entry and call entry cancellation.

* * * * *